US010436059B2

(12) United States Patent
Liu et al.

(10) Patent No.: US 10,436,059 B2
(45) Date of Patent: Oct. 8, 2019

(54) ROTATING STALL DETECTION THROUGH RATIOMETRIC MEASURE OF THE SUB-SYNCHRONOUS BAND SPECTRUM

(71) Applicant: Simmonds Precision Products, Inc., Vergennes, VT (US)

(72) Inventors: Lei Liu, Shelburne, VT (US); Randal Bradley Page, Vergennes, VT (US)

(73) Assignee: SIMMONDS PRECISION PRODUCTS, INC., Vergennes, VT (US)

( * ) Notice: Subject to any disclaimer, the term of this patent is extended or adjusted under 35 U.S.C. 154(b) by 1550 days.

(21) Appl. No.: 14/275,339

(22) Filed: May 12, 2014

(65) Prior Publication Data

US 2015/0322814 A1 Nov. 12, 2015

(51) Int. Cl.
*F01D 21/00* (2006.01)
*F04D 27/00* (2006.01)

(52) U.S. Cl.
CPC ..... *F01D 21/003* (2013.01); *F04D 27/001* (2013.01)

(58) Field of Classification Search
CPC ..... F04D 27/001; G06Q 10/06311; G01N 22/04; F01D 21/003
See application file for complete search history.

(56) References Cited

U.S. PATENT DOCUMENTS 5,174,729 A 12/1992 Waters et al.
5,235,340 A * 8/1993 Shea ..... H01Q 21/245 342/188
6,532,433 B2 3/2003 Bharadwaj et al.
7,677,090 B2 3/2010 Moen
8,337,144 B2 12/2012 Stabley et al.
8,342,794 B2 1/2013 Staroselsky et al.
2007/0110020 A1* 5/2007 Kroeger ..... H04H 20/30 370/343
2008/0234958 A1* 9/2008 Kupfer ..... G01N 22/04 702/75
2010/0296914 A1* 11/2010 Staroselsky ..... F04D 27/001 415/47

(Continued)

OTHER PUBLICATIONS

Sever "Experimental validation of turbomachinery blade vibration predictions" p. i-x, 1-228, A-1/A-13, B-1/B-3 (Year: 2004).*

(Continued)

*Primary Examiner* — Regis J Betsch
*Assistant Examiner* — Kaleria Knox
(74) *Attorney, Agent, or Firm* — Snell & Wilmer, L.L.P.

(57) ABSTRACT

A method for obtaining a baseline for detecting rotating stall using localized information already included within the frequency spectrum. Namely, ratiometric measures, i.e., quadratic coefficients obtained from weighted quadratic regression of sub-synchronous spectrum and/or information obtained through peak detections, are used to detect rotating stall. These ratiometric measures are configured to isolate changes caused by rotating stall from those caused by other operational conditions. As a result, new baseline information can be established to more reliably characterize a system, such as a system with associated turbines or compressors. Empirical or statistical approaches can be combined to automate the process of obtaining a new baseline and to detect rotating stall.

15 Claims, 3 Drawing Sheets

(56) References Cited

U.S. PATENT DOCUMENTS

| | | | | |
|---|---|---|---|---|
| 2011/0112878 | A1* | 5/2011 | Isom | G06Q 10/06311 705/7.13 |
| 2012/0109580 | A1* | 5/2012 | Holroyd | G01H 1/12 702/182 |
| 2013/0142617 | A1* | 6/2013 | Rossi | F04D 27/001 415/1 |

OTHER PUBLICATIONS

Harmsen "Design of a Wideband Jammer Detector" M.Sc.Thesis pp. I-VIII, 1-120 (Year: 2003).*
Extended European Search Report dated Oct. 2, 2015 in European Application No. 15166948.8.

* cited by examiner

ROTATING STALL DETECTION THROUGH RATIOMETRIC MEASURE OF THE SUB-SYNCHRONOUS BAND SPECTRUM

CROSS-REFERENCE TO RELATED APPLICATIONS

Field

The present disclosure relates to the detection of a rotating stall, and more particularly, to the detection of rotating stall utilizing the sub-synchronous band spectrum.

BACKGROUND

The adverse effects of a surge can cause premature or even catastrophic failures for most turbines and compressors. Rotating stall, which may be an indicator for incipient surge and sometimes causing premature failures by itself, can be identifiable from the sub-synchronous band spectrum obtained from a variety of types of signals.

Existing techniques detect rotating stall by directly comparing the frequency spectrum in a sub-synchronous band with preset thresholds obtained from the baseline spectrum. They utilize the fact that the stall incurs increased energy on certain frequency components that are fractions of the compressor speed, but often overlook the difficulties and the uncertainties involved in establishing a baseline for detection. As the frequency response and noise characteristics will vary significantly with respect to operational conditions, the existing techniques based on direct comparison may not provide reliable results.

SUMMARY

The present disclosure relates to a system and/or method of determining rotating stall. According to various embodiments the method may include calculating, by a computer based system configured to detect rotating stall, a power spectrum density (PSD) from data collected for a signal in the time domain. The method may include determining, by the computer based system, a synchronous frequency component of the signal from external signal sources. The method may include identifying, by the computer based system, a frequency band from the calculated power spectrum density and the determined synchronous frequency as a sub-synchronous spectrum band. The method for determining, by the computer based system, rotating stall may include calculating a quadratic function approximation to the identified frequency spectrum in the identified sub-synchronous spectrum band. The method may include setting, by the computer based system, the calculated quadratic function approximation coefficient to zero if at least one of the calculated quadratic function approximation coefficient is a positive number and the peak of the calculated quadratic function approximation is located outside the identified sub-synchronous spectrum band. The method for determining rotating stall may include analyzing, by the computer based system, the quadratic coefficient as an indicator of rotating stall for at least one of a baseline and detection. The method may further include comparing, by the computer based system, instant conditions against the determined baseline to identify the occurrence of rotating stall in substantially real-time.

According to various embodiments the method may include calculating, by a computer based system configured to detect rotating stall, a frequency spectrum from data collected for a signal in the time domain. The method may include determining, by the computer based system, a synchronous frequency component of the signal from external signal sources. The method may include utilizing, by the computer based system, ratiometric measures to determine the baseline for determining rotating stall, wherein the ratiometric measures comprise quadratic coefficients obtained from weighted quadratic regression of a sub-synchronous spectrum. The method may further include comparing, by the computer based system, instant conditions against the determined baseline to identify the occurrence of rotating stall in substantially real-time.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the drawing figures, wherein like numerals denote like elements.

DETAILED DESCRIPTION

Figure 1:
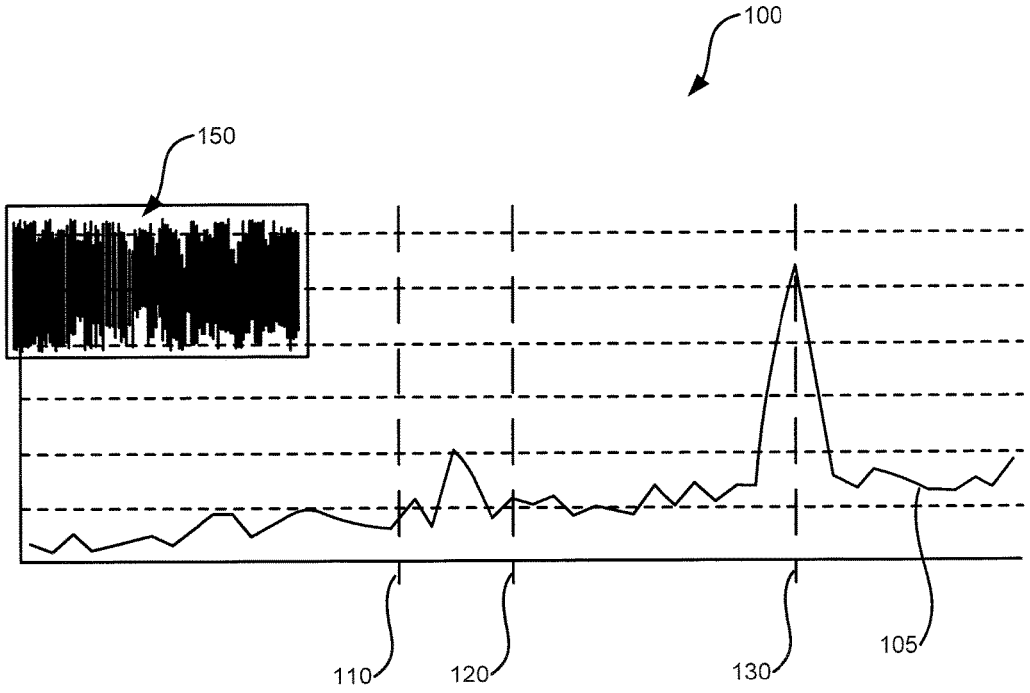
FIG. 1 is a representative sub-synchronous band spectrum in accordance with various embodiments.

The detailed description of exemplary embodiments herein makes reference to the accompanying drawings, which show exemplary embodiments by way of illustration and their best mode. While these exemplary embodiments are described in sufficient detail to enable those skilled in the art to practice the disclosure, it should be understood that other embodiments may be realized and that logical changes may be made without departing from the spirit and scope of the disclosure. Thus, the detailed description herein is presented for purposes of illustration only and not of limitation. For example, the steps recited in any of the method or process descriptions may be executed in any order and are not necessarily limited to the order presented. Furthermore, any reference to singular includes plural embodiments, and any reference to more than one component or step may include a singular embodiment or step.

During the operation of a gas turbine, there may occur a phenomenon known as rotating stall (sometimes referred to as compressor stall) wherein the pressure ratio of the turbine compressor initially exceeds some threshold value at a given speed, resulting in a subsequent reduction of compressor pressure ratio and airflow delivered to the engine combustor. Rotating stall may occur due to a range of factors, such as in response to an engine accelerating too rapidly, or in response to an inlet profile of air pressure or temperature becoming unduly distorted during normal operation of the engine. Compressor damage due to malfunction of a portion of the engine control system may also result in rotating stall and subsequent compressor degradation. If rotating stall remains undetected and permitted to continue, the combustor temperatures and the vibratory stresses induced in the compressor may become sufficiently high to cause damage to the turbine. Moreover, as previously mentioned, rotating stall may be an indicator for incipient surge and sometimes causing premature failures by itself, can be identifiable from the sub-synchronous band spectrum obtained from a variety of types of signals, including but not limited to vibration, pressure, acoustic, strain and displacement. Any appropriate sensor, gauge, or scope may be utilized for measuring the type of signal and sub-synchronous band spectrum. For instance, a spectrum analyzer may be configured to measure input signal versus frequency.

The difficulties and uncertainties found in the existing rotating stall detection methods described above are addressed by utilizing the localized information already included within the frequency spectrum. Namely, ratiometric measures, i.e., quadratic coefficients obtained from weighted quadratic regression of sub-synchronous spectrum and/or information obtained through peak detections, are used to detect rotating stall. Unlike the absolute measure implied in conventional direct comparison against a baseline spectrum, these ratiometric measures are able to isolate changes caused by rotating stall from those caused by other operational conditions. As a result, new baseline information can be established and configured to more reliably characterize a system, such as a system with associated turbines or compressors. Empirical or statistical approaches can be combined to automate the process of obtaining a new baseline and to detect rotating stall. In this way, a relative measure, based on the information already included in the surrounding sub-synchronous spectrum band may be utilized which ultimately reduces operator calibration effort and time as compared with other approaches.

Rotating stall has been recognized as a useful indicator for detecting incipient surges and suggests the existence of dynamic instability towards a full system surge. A full system surge may lead to potential catastrophic failure of an associated compressor system. In some extents, rotating stall alone can directly result in excessive stress at the roots of fan blades beyond design limits and cause accelerated fatigue for compressor blades. Therefore, it is of particular interest to detect rotating stall to provide an early surge warning and to prevent premature failures.

From the external point of view, rotating stall may be seen as a parasitic energy source that can be observed in many physical forms, such as distorted pressure profiles, increased vibration magnitude and/or emerging sound tones. Although these symptoms can vary significantly with respect to physical variables and the observation location, a common characteristic in the frequency domain is the increased magnitude of a few adjacent frequency components at the sub-synchronous band. Again, depending on the speed and the number of stall cells which are ultimately determined by the compressor design and operating conditions, the central frequency component generally moves between a band, such as within the band of about 0.2 to 0.8 times, of the fan rotating frequency.

Conventionally, there are no reliable analytical or numerical techniques to exactly estimate frequency components of rotating stall. A handful of approaches using thermodynamic theory have been developed to quantitatively describe the formation of rotating stall but none of them are practically useful to correctly model and predict rotating stall due to the high degree of abstraction and myriad of ever changing parameters involved. In common practice, a direct comparison of magnitude or energy over a sub-synchronous band against a pre-calibrated baseline spectrum may be used to characterize rotating stall for a given design and an operating condition. Nevertheless, as it is difficult to collect baseline for all possible operating conditions, the ambiguity associated with the proper identification of rotating stall's frequency components, i.e., the frequency band and the corresponding magnitude or energy, are amplified along with the uncertainties associated with noises when they are further included in the baseline information to detect rotating stall.

Another significant difficulty when using the conventional direct comparison approach is that varying excitations, e.g., changes of vibration sources in both frequency and amplitude, make absolute difference very difficult to be characterized and modelled as a frequency component of the rotating stall moves along with the fan speed. This can be intuitively understood by appreciating global changes of the baseline spectrum with respect to different fan speeds. For example, the vibration caused by a fan at high speed may be much larger than when the fan is running at a low speed, causing increased energy over entire sub-synchronous band.

Yet another difficulty is that rotating stall may appear or disappear abruptly and only occur in a transient fashion for a particular system. That is, only a narrow range of operating conditions around the surge region will incur rotating stall. In response to leaving this region, the indications of rotating stall vanish regardless of whether the system is further back to normal or remains under surge. When the fan acceleration is non-zero, rotating stall may appear and disappear quickly, and may be misidentified as random noise or appear smoothed out when observed in the frequency spectrum if averaging is conducted.

A few existing techniques based on the conventional direct comparison approach are cited below. Note that in those references the terms "magnitude" and "energy" are generally used interchangeably as they point to the identical physical characteristics extracted from spectrum analysis: the energy in a band simply refers to the square of magnitude for the same band.

The present disclosure addresses the aforementioned difficulties by using ratiometric measures obtained from spectrum shapes to circumvent direct comparison. The core difference between the present disclosure and conventional approaches is that ratiometric measures, instead of absolute measures, extract the information related to rotating stall by measuring relative changes directly from a single set of spectrum in the vicinity of sub-synchronous band. As these relative changes isolate potential contamination resulted from changes caused by other operational conditions, e.g., varying excitations, the ratiometric measures are able to not only utilize all information already available within the spectrum, but also be utilized to establish baseline coordinates with less system/operation dependence.

According to various embodiments, a quadratic function approximation to establish new baseline coordinates and to detect rotating stall may be utilized. Curvatures measured from the spectrum in the sub-synchronous band, i.e., quadratic coefficients, may be used to quantitatively characterize the changes caused by rotating stall. The shape of a spectrum, instead of the amplitude, is calculated and used as a baseline. Thus, this method retains the fundamental information associated with rotating stall, i.e., the significantly increased amplitude/energy of some frequency components over the sub-synchronous band. The uncertainties associated with finding the exact location and amplitude of the frequency components related to rotating stall is circumvented by the quadratic fitting.

Figure 2:
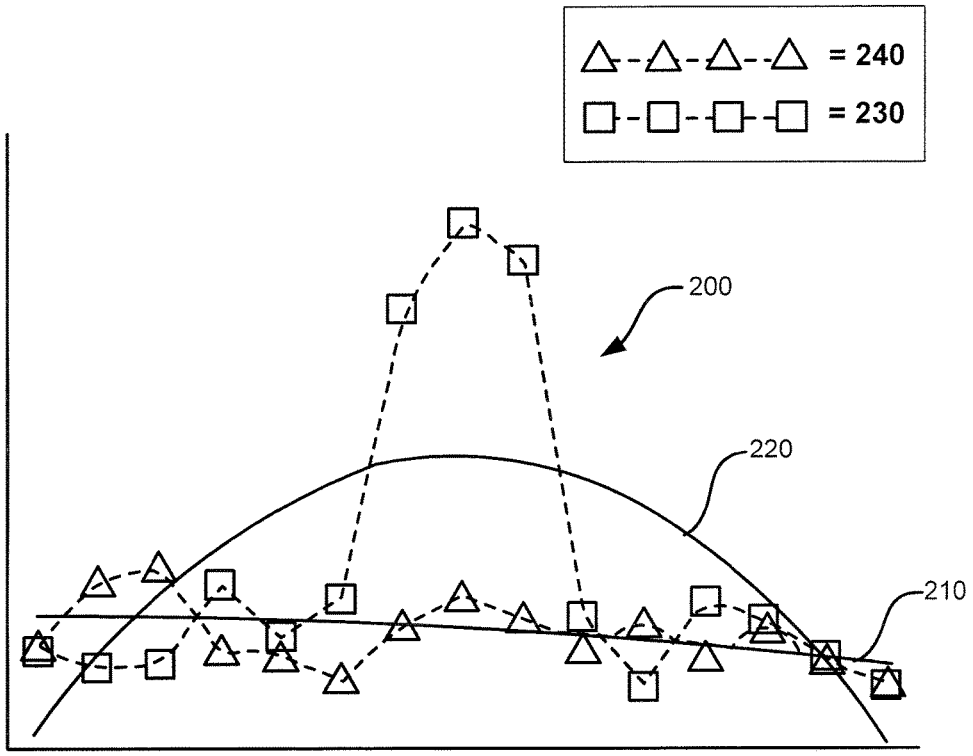
FIG. 2 is a representative weighted quadratic regression of the sub-synchronous spectrum in accordance with various embodiments.

According to various embodiments and with reference to FIGS. 1 and 2, a sub-synchronous band may be identified from a sample of the frequency spectrum. FIG. 1 depicts a simplified diagram 100 of a representative signal 150 and its PSD curve 105 showing its characteristics in the time domain and in the frequency domain. For instance, an exemplary snapshot of a signal in time domain is shown by plot 150. Designators 130 referencing a peak such as a the fan/shaft speed frequency (synchronous component). The sub-synchronous band related to the rotating stall may be designated as being between indicators 110 and 120.

Figure 3:
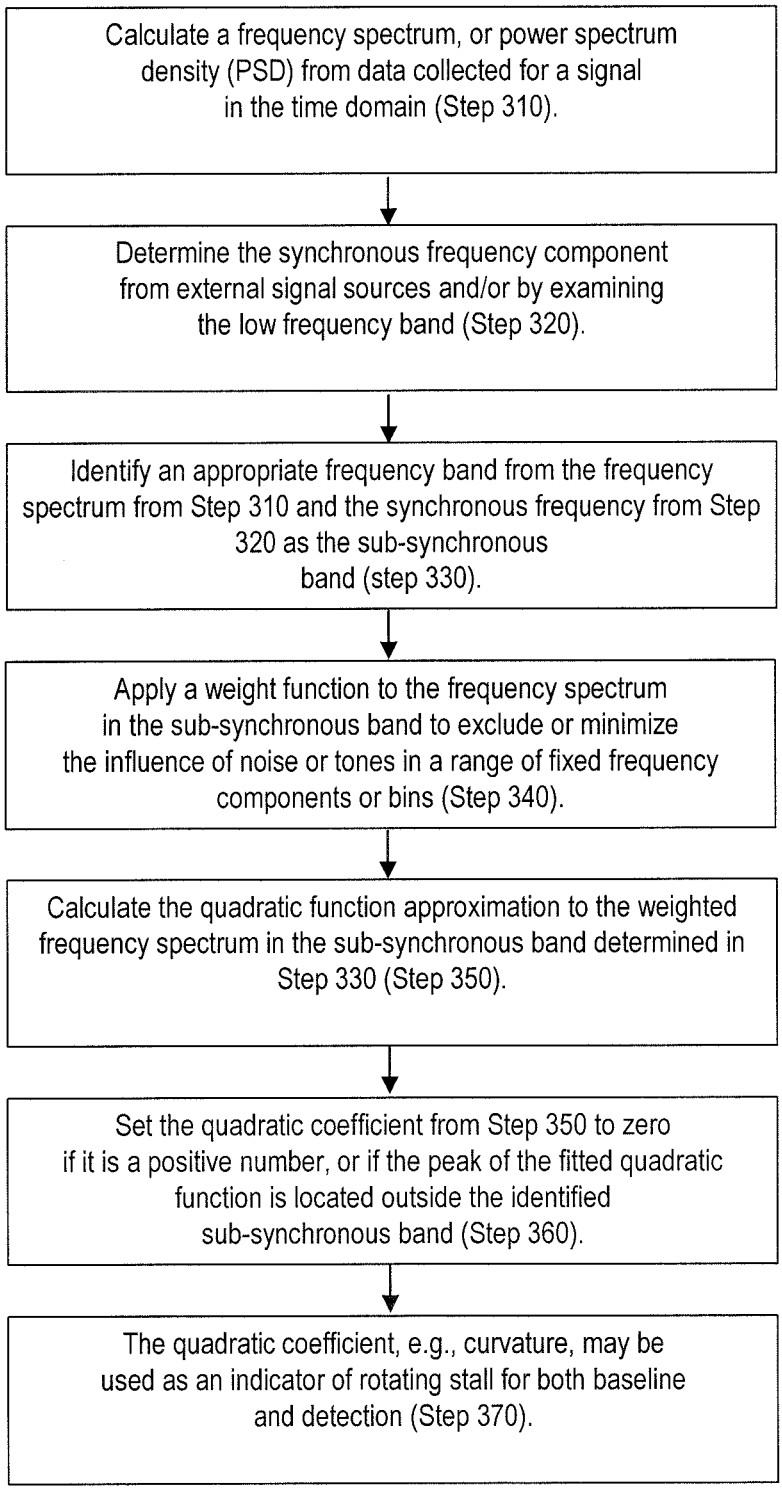
FIG. 3 is an exemplary flow chart for determining rotating stall in accordance with various embodiments.

Curvatures measured from the spectrum in the sub-synchronous band in FIG. 2 may be used as an indicator for setting the baseline and ultimately detecting rotating stall. FIG. 2 depicts a simplified diagram 200 showing a zoom-in view of the sub-synchronous band, in which two exemplary PSD curves, PSD with rotating stall 230 and PSD without rotating stall 240 are illustrated. Also, the results from quadratic regression 220, 210 for both PSD are illustrated. For instance, plot 220 depicts the quadratic regression results from PSD with rotating stall 230 and plot 210 depicts the quadratic regression results from PSD without rotating stall 240. According to various embodiments and with reference to FIG. 3, the steps to perform this method may comprise calculating a frequency spectrum, also referred to as power spectrum density (PSD) from data collected for a signal in the time domain (Step 310). The signal may have various forms, including vibration, acoustics, and/or pressure. Optionally, depending on the transient status of a system, variance in the frequency spectrum can be reduced using various well-known approaches, such as Welch's averaging. For instance, the Welch averaging method is based on the concept of using periodogram spectrum estimates, which are the result of converting a signal from the time domain to the frequency domain. The synchronous frequency component may be determined, (i.e., the fan/shaft mechanical speed) from external signal sources and/or by examining the low frequency band (Step 320). For instance, external sources, e.g., an optical tachometer, may be used to obtain real-time shaft speed. Alternatively, in response to external sources not being available, numerical based pitch detection algorithms, such as maximum peak detection, harmonic product spectrum or cepstral analysis, can be used to determine the synchronous frequency component. Cepstral analysis as used herein may refer to a signal processing approach that utilizes the presence of harmonics to identify the fundamental tone. Next, an appropriate frequency band from the frequency spectrum from Step 310 and the synchronous frequency from Step 320 as the sub-synchronous band may be identified (Step 330). A ratio, fixed or synchronous frequency dependent, can be identified experimentally or obtained from literature, e.g., 0.56 for an axial compressor with a hub-to-tip radius ratio of 0.5. The ratio may provide a rough estimation about the sub-synchronous band and may not be exact. Subsequently, the ratio can be used along with the synchronous frequency to obtain a constant-width band or a constant-percentage band to determine a sub-synchronous band for the particular synchronous frequency (or fan/shaft mechanical speed). For example, a constant-percentage band between 0.5 and 0.65 times of fan speed has been found to be useful in the application for a particular axial compressor. A weight function may be applied to the frequency spectrum in the sub-synchronous band to exclude or minimize the influence of noise or tones in a range of fixed frequency components or bins (Step 340).

The weight function may be empirically chosen based on prior knowledge on noise distribution. For instance, noise around and/or at a desired operating frequency such as 60 Hz from may be excluded by assigning less weight around the surrounding band. Note that the frequency spectrum can be expressed in various mathematical forms, such as amplitude spectrum, and power spectrum and/or power spectral density. Weights of the weight function may be adjusted accordingly upon the actual forms being used. If all frequency components have the same significance, an equal weight can be used. The quadratic function approximation to the weighted frequency spectrum in the sub-synchronous band determined in Step 330 may be calculated, using any standard regression method, e.g., linear least squares or maximum likelihood (Step 350). Various regression techniques can be applied depending on the availability of a priori knowledge on noise characteristics. In general practices, noise can be assumed to be normally distributed after appropriate weighting in Step 340, such that a simple linear least squares approach may be sufficient. The quadratic coefficient from Step 350 may be set to zero if it is a positive number, or if the peak of the fitted quadratic function is located outside the identified sub-synchronous band (Step 360). Note that the quadratic coefficient suggests the curvature of the frequency spectrum of the sub-synchronous band. As the energy from rotating stall is superimposed over energy from other sources within the sub-synchronous band, the said curvature with the presence of rotating stall should be negative. To be complete, however, a potential exception for negative curvature without rotating stall is when the frequency spectrum in the sub-synchronous band is monotonic in a wide-sense. Therefore, the zeroing in this step may be utilized to recognize the shape of the frequency spectrum correctly. The quadratic coefficient, e.g., curvature, may be used as an indicator of rotating stall for both baseline and detection as explained below (Step 370). Instant conditions may be compared against the determined baseline to identify the occurrence of rotating stall in substantially real-time.

In an exemplary embodiment, it can be seen that the same fundamental characteristics of rotating stall as utilized by the previously existing techniques to detect rotating stall, i.e., the increased energy over certain frequency components in the sub-synchronous band, may be used to assert its existence. However, a difference is the utilization of the shape information in frequency spectrum in order to address the various uncertainties involved in correctly measuring the amount and the location of such increases as aforementioned.

The difficulty associated with varying excitation can be addressed by the curvature as it is a measure of the ratio of the peak component to the rest of the identified sub-synchronous band. This ratio takes advantage of the fact that rotating stall can be attributed to changes in a narrow frequency band, whereas changes of excitation often result in global changes across a wide frequency band. In comparison with a conventional absolute measure, this ratiometric or relative measure is able to utilize all information contained in frequency spectrum and detect local changes more reliably.

In addition, the effects of signal noise, such as those becoming pronounced when spectral averaging is purposefully avoided to detect transient rotating stall, can be surpassed in these ratiometric measures by taking advantage of the inherent large signal-to-noise ratio of rotating stall. For instance, the application of a weight function in Step 340 also may play a role in improving detection reliability. It is well known that self-excited energy sources, such as oil whirling from a journal bearing, may start to be proactive after the fan speed exceeds a certain value, and they are difficult to be distinguished from rotating stall directly as they exhibit similar characteristics except being confined within a fixed band. The weight function can incorporate such prior knowledge to exclude the effects from artifacts that are unrelated to rotating stall.

Utilizing the curvatures obtained across a range of speeds and corresponding known statuses of a system, baseline information across speeds for the given system can be established. This can be done by empirically choosing a few discrete speed cases to determine a threshold value or threshold line as a function of speeds; or statistically examining the distribution of curvatures with respect to continuously changing speeds and approximate corresponding conditional probability function in a continuous form or conditional probability table in a discrete form. The determination of the presence of rotating stall thereby can be made by comparing/interpreting further curvature results with the newly established baseline.

According to various embodiments, equivalent expression may replace the aforementioned curvatures from the quadratic fitting by similar ratiometric measures, e.g., kurtosis or crest factor as peakedness indicators. Note that the exact choice depends on the behavior of the system under examination, i.e., how fast the speed of the compressor changes, or whether the resolution in frequency domain is sufficiently large. This is due to these indicators having their origins in descriptive statistics, and rely on a large amount of samples to have statistical significance. On one hand, the aforementioned curvatures is preferable when short time windows are desired in practice to detect transient events because limited frequency resolution in turn results from those indicators vulnerable to noise. On the other hand, when the system is known to maintain steady status, those indicators may be used to provide baselines with better separation or additional information, e.g., pinpointing the location of the frequency component of rotating stall.

It is possible to use other methods of peak detection beyond the quadratic/curvature method described above. According to various embodiments, a sliding block scheme may be employed, wherein the spectral band of interest is divided into sub-regions, of a size comparable to expected peak/valley features. A measure of the spectral magnitude within each block, such as RMS, may then be computed. From this sequence, two thresholds may be derived, one for peak detection and one for valley detection. They might, for example, be assigned to fractional values intermediate between the minimum and maximum block values, say 0.2 and 0.5. It is important that a peak or valley is not declared unless previously "armed" by an occurrence of its opposite. To prevent unwanted detection of multiple peaks or valleys, the arming is disabled immediately upon detection. The occurrence of the sought-for feature (stall, surge, etc.) is then declared only if a peak detection is followed by a valley detection, such that both sides of the peak are guaranteed to be surrounded by valleys.

Any of the methods described herein are contemplated to be carried out via a computer-based system. In fact, in various embodiments, the embodiments are directed toward one or more computer systems capable of carrying out the functionality described herein. The computer system includes one or more processors, such as processor. The processor may be connected to a communication infrastructure (e.g., a communications bus, cross-over bar, or network). Various software embodiments are described in terms of this exemplary computer system. After reading this description, it will become apparent to a person skilled in the relevant art(s) how to implement various embodiments using other computer systems and/or architectures. Computer system can include a display interface that forwards graphics, text, and other data from the communication infrastructure (or from a frame buffer not shown) for display on a display unit.

According to various embodiments, the computer based-system may comprise a system including a host server including a processor for processing digital data, a memory coupled to said processor for storing digital data, an input digitizer coupled to the processor for inputting digital data, an application program stored in said memory and accessible by said processor for directing processing of digital data by said processor, a display coupled to the processor and memory for displaying information derived from digital data processed by said processor and a plurality of databases.

According to various embodiments, a system comprising a processor, a tangible, non-transitory memory configured to communicate with the processor, the tangible, non-transitory memory having instructions stored thereon that, in response to execution by the processor, cause the processor to perform operations comprising calculating, by the processor, a power spectrum density (PSD) from data collected for a signal in the time domain. The system may include determining, by the processor, a synchronous frequency component of the signal from external signal sources. The system may include identifying, by the processor, a frequency band from the calculated power spectrum density and the determined synchronous frequency as a sub-synchronous band. The system may include calculating, by the processor, a quadratic function approximation to the identified frequency spectrum in the identified sub-synchronous band. The system may include setting, by the processor, the calculated quadratic function approximation coefficient to zero if at least one of the calculated quadratic function approximation coefficient is a positive number and the peak of the calculated quadratic function approximation is located outside the identified sub-synchronous band. The system may include analyzing, by the processor, the quadratic coefficient as an indicator of and to determine rotating stall for setting a baseline and/or detection.

In various embodiments, software may be stored in a computer program product and loaded into computer system using removable storage drive, hard disk drive or communications interface. The control logic (software), when executed by the processor, causes the processor to perform the functions of various embodiments as described herein. In various embodiments, hardware components such as application specific integrated circuits (ASICs). Implementation of the hardware state machine so as to perform the functions described herein will be apparent to persons skilled in the relevant art(s).

The term "non-transitory" is to be understood to remove only propagating transitory signals per se from the claim scope and does not relinquish rights to all standard computer-readable media that are not only propagating transitory signals per se. Stated another way, the meaning of the term "non-transitory computer-readable medium" and "non-transitory computer-readable storage medium" should be construed to exclude only those types of transitory computer-readable media which were found in In Re Nuijten to fall outside the scope of patentable subject matter under 35 U.S.C. § 101.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C.

Systems, methods and apparatus are provided herein. In the detailed description herein, references to "various embodiments", "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments. Different cross-hatching is used throughout the figures to denote different parts but not necessarily to denote the same or different materials.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f) unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A method comprising:

calculating, by a computer based system configured to detect rotating stall in an engine, a power spectrum density (PSD) from data collected for a signal in the time domain;

determining, by the computer based system, a synchronous frequency component from at least one of the signal or an external signal source, wherein the external signal source comprises an optical tachometer configured to obtain real-time shaft speed;

identifying, by the computer based system, a frequency band from the calculated PSD and the determined synchronous frequency component as a sub-synchronous spectrum band;

calculating, by the computer based system, a quadratic function approximation coefficient to the identified frequency band in the identified sub-synchronous spectrum band;

setting, by the computer based system, a calculated quadratic function approximation coefficient to zero if at least one of the calculated quadratic function approximation coefficient is a positive number and the peak of the calculated quadratic function approximation is located outside the identified sub-synchronous spectrum band; and analyzing, by the computer based system, the quadratic function approximation coefficient as an indicator of rotating stall for at least one of a baseline and detection.

2. The method of claim 1, further comprising applying, by the computer based system, a weight function to the frequency spectrum in the sub-synchronous spectrum band.

3. The method of claim 2, wherein the weight function is configured to at least one of exclude and minimize the influence of at least one of noise and tones in a range of fixed frequency components.

4. The method of claim 1, wherein the analyzing the quadratic function approximation coefficient as the indicator of the rotating stall further comprises inspecting the curvature of the quadratic function approximation coefficient.

5. The method of claim 1, further comprising processing, by the computer based system, localized information included within the frequency spectrum to determine the baseline for determining the rotating stall.

6. The method of claim 1, further comprising employing a sliding block scheme, wherein a spectral band of interest is divided into sub-regions of a size comparable to expected peak and valley features.

7. The method claim 1, wherein ratiometric measures are processed to determine the baseline for determining the rotating stall, wherein the ratiometric measures comprise quadratic coefficients obtained from weighted quadratic regression of the sub-synchronous spectrum band.

8. The method of claim 1, further comprising processing ratiometric measures obtained from spectrum shapes in the sub-synchronous spectrum band to circumvent at least one of direct comparison and absolute measures to determine the baseline.

9. The method of claim 1, wherein relative changes measured directly from a single set of spectrum in the vicinity of the sub-synchronous spectrum band are used to determine the rotating stall.

10. The method of claim 1, wherein the shape of a spectrum is calculated and processed as the baseline for the detection of the rotating stall.

11. The method of claim 1, wherein at least one of kurtosis and crest factor analysis is processed by the computer based system as a peakedness indicator for the detection of the rotating stall.

12. The method of claim 1, wherein the synchronous band spectrum is obtained from at least one of a vibration signal, a pressure signal, an acoustic signal, a strain signal and a displacement signal.

13. The method of claim 1, further comprising comparing, by the computer based system, instant conditions against the baseline to identify the occurrence of rotating stall in substantially real-time.

14. A method for determining rotating stall in an engine comprising:

calculating, by a computer based system configured to detect rotating stall in the engine, a frequency spectrum from data collected for a signal in the time domain;

determining, by the computer based system, a synchronous frequency component from at least one of the signal or an external signal source, wherein the external signal source comprises an optical tachometer configured to obtain real-time shaft speed;

processing, by the computer based system, ratiometric measures to determine a baseline for determining rotating stall, wherein the ratiometric measures comprise quadratic coefficients obtained from weighted quadratic regression of a sub-synchronous spectrum;

calculating, by the computer based system, a quadratic function approximation coefficient to the sub-synchronous spectrum;

setting, by the computer based system, the quadratic function approximation coefficient to zero if at least one of the quadratic function approximation coefficient is a positive number and a peak of the quadratic function approximation is located outside the sub-synchronous spectrum; and analyzing, by the computer based system, the quadratic function approximation coefficient as an indicator of rotating stall.

15. The method of claim 14, further comprising comparing, by the computer based system, instant conditions against the baseline to identify the occurrence of rotating stall in substantially real-time.

* * * * *